US006024256A

United States Patent [19]

Beck et al.

[11] Patent Number: 6,024,256

[45] Date of Patent: Feb. 15, 2000

[54] TAMPER-EVIDENT CLOSURE

[75] Inventors: James M. Beck, Long Grove; Thomas C. Stoneberg, Buffalo Grove, both of Ill.

[73] Assignee: Creative Packaging Corp., Buffalo Grove, Ill.

[21] Appl. No.: 09/027,126

[22] Filed: Feb. 20, 1998

Related U.S. Application Data

[63] Continuation-in-part of application No. 08/726,511, Oct. 7, 1996, Pat. No. 5,829,611.

[51] Int. Cl.[7] ..... B67D 5/06

[52] U.S. Cl. ..... 222/153.06; 222/182; 222/521; 222/525

[58] Field of Search ..... 222/153.06, 182, 222/519, 520, 521, 522, 523, 524, 525, 541.6

[56] References Cited

U.S. PATENT DOCUMENTS

| | | | |
|---|---|---|---|
| 4,624,378 | 11/1986 | Sawicki | 215/230 |
| 4,709,823 | 12/1987 | Beck et al. | 215/235 |
| 4,746,035 | 5/1988 | Anderson et al. | 222/153 |
| 4,821,897 | 4/1989 | Weiler | 215/32 |
| 4,919,285 | 4/1990 | Roof et al. | 215/230 |
| 5,085,333 | 2/1992 | Dutt et al. | 215/250 |
| 5,284,263 | 2/1994 | Papciak | 215/230 |
| 5,335,802 | 8/1994 | Brach et al. | 215/235 |
| 5,456,374 | 10/1995 | Beck | 215/251 |
| 5,507,416 | 4/1996 | Rapchak et al. | 222/153.07 |
| 5,680,965 | 10/1997 | Beck | 222/153.06 |

*Primary Examiner*—Joseph A. Kaufman
*Attorney, Agent, or Firm*—Silverman, Cass & Singer, Ltd.

[57] ABSTRACT

A tamper-evident closure including a cap having a base and an upstanding post, the base defining a circular channel. A spout is positioned on the upstanding post, with the spout carrying a circumferential skirt permanently retained in the circular channel. A frangible line of weakness permits separation of the spout from the circumferential skirt. The spout and circumferential skirt are of a color that contrasts with the color of the base and post, so that, upon movement of the spout on the post, the circumferential skirt remains in the channel to provide a visual indication of such movement.

10 Claims, 7 Drawing Sheets

TAMPER-EVIDENT CLOSURE

CROSS REFERENCE TO RELATED APPLICATION

This application is a continuation-in-part of U.S. application Ser. No. 08/726,511, filed Oct. 7, 1996, now U.S. Pat. No. 5,829,611, entitled "Tamper-Evident Overcap" (hereinafter referred to as "Related Application"), the disclosure of which hereby is incorporated herein by reference. Both the present application and the Related Application are owned by the same Assignee.

BACKGROUND OF THE INVENTION

1. Field of the Invention

This invention relates generally to closures for re-sealable containers, and more particularly, to a tamper-evident closure for such containers.

2. Description of the Prior Art

Tamper-evident closures are known and used for many different types of re-sealable containers. Such closures typically include a cap mounted to the top of the container, the cap having a base part and a spout positioned on the base. The spout is movable between a first closed position on the cap in which dispensing of the contents of the container is prevented, and a second open position which permits dispensing of the container contents through the cap.

It is desirable for such closures to have some indication that the spout has been moved from the closed to open position to alert the user of the container to the fact of possible tampering with the contents.

Prior art closures commonly are formed of plastic material in which the spout is of the same color as the remaining portions of the closure. In such closures, it is difficult for a user to be alerted to the fact of possible unauthorized opening of the closure because the common color of all elements of the closure does not provide a clear visual indication that the spout has been moved to its open position. Even if the spout is formed of a material which is different in color than the color of the remaining portions of the closure, visual indication of opening and possible tampering with the contents of the container may not optimally be achieved.

The present invention provides a highly visible tamper-evident indicator of movement of the spout of a closure from its closed to its open position, so that the user will have a clear and obvious indication of possible tampering with the contents of the container on which the closure is positioned.

SUMMARY OF THE INVENTION

The invention provides a tamper-evident closure for a container in which the tamper-evident characteristic is enhanced in a manner which provides a significant, highly visible indication to the user, above and beyond mere elevation of the closure spout on its associated base.

The invention includes a cap for a container, the cap including a base with a spout movable on the base between a first closed position and a second open position. The base defines a circumferential channel, which may be completely circular, or may define interrupted arcs or some other portion of a circle.

The spout carries a circumferential skirt of a cross-sectional configuration which is similar to that of the circumferential channel located in the base. The skirt is permanently retained within the channel, such as by force-fitting, or by gluing, RF sealing, or other similar method.

A frangible line of weakness, such as spaced spot seals or other connecting members, permits separation of the spout from the circumferential skirt when the spout is twisted or pulled with respect to the base. The spout and its circumferential skirt are formed of an integral structure, being typically a single, molded item, and also, are of a color that is different from the color of the base. The respective colors of the spout with its skirt on the one hand, and the base on the other hand, preferably are chosen to be of contrasting nature. Thus, the spout and base are formed from materials which are of different visual perception that enables an observer to differentiate one from the other. In other words, for example, if the spout and its skirt is a white color, the base may be a dark blue and thereby a color which is highly contrasting to the white color of the spout and its skirt. Wide variations in selected colors to enhance the intended contrasting feature are possible, so that the circumferential skirt, permanently secured in the circumferential channel, is clearly visible and noticeable when the spout is separated from its skirt and moved on the base.

The tamper-evident closure of the invention also may be used in conjunction with the tamper-evident overcap disclosed in the Related Application. In such case, both the spout and overcap will be formed of a material having a color different from, and contrasting with, the color of the base on which the spout and overcap are positioned. In instances where the overcap of the Related Application is used together with the closure of the present invention, a second circumferential channel is formed in the base concentric with the first circumferential channel. The skirt of the overcap is permanently retained in the second circumferential channel to afford the benefits and advantages thereof, and in the constructional manner as disclosed in the Related Application.

DESCRIPTION OF THE PREFERRED EMBODIMENTS

Figure 1:
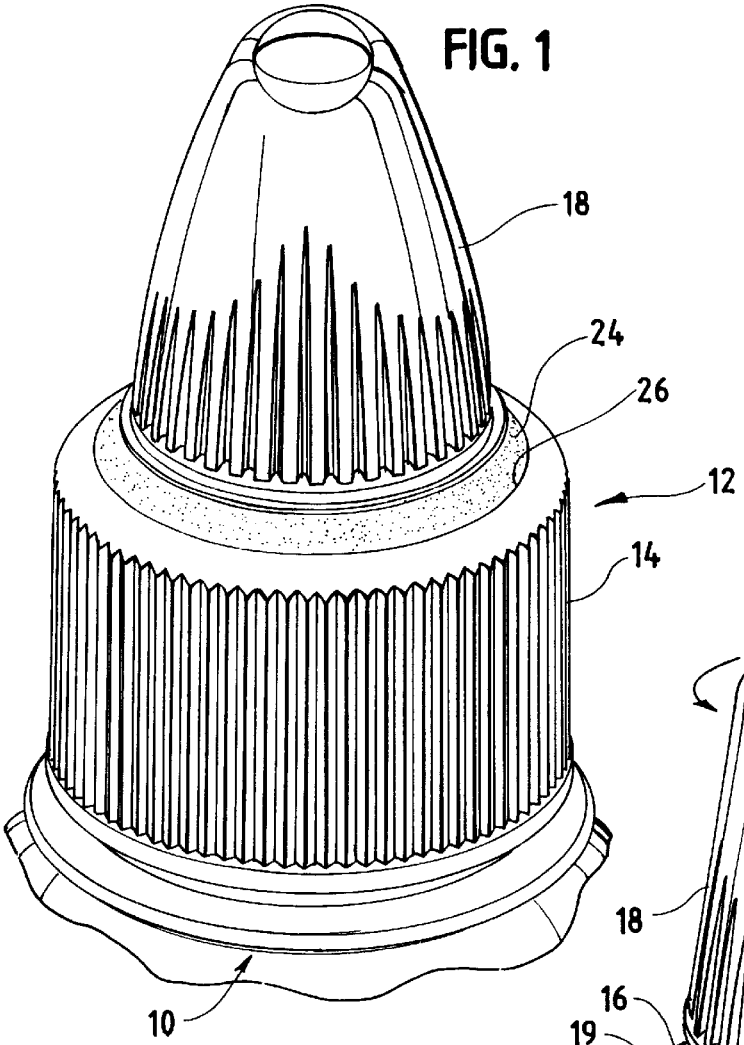
FIG. 1 is a perspective view of a closure with base and spout constructed in accordance with this invention, with the spout shown in its initial, closed position.
Figure 2:
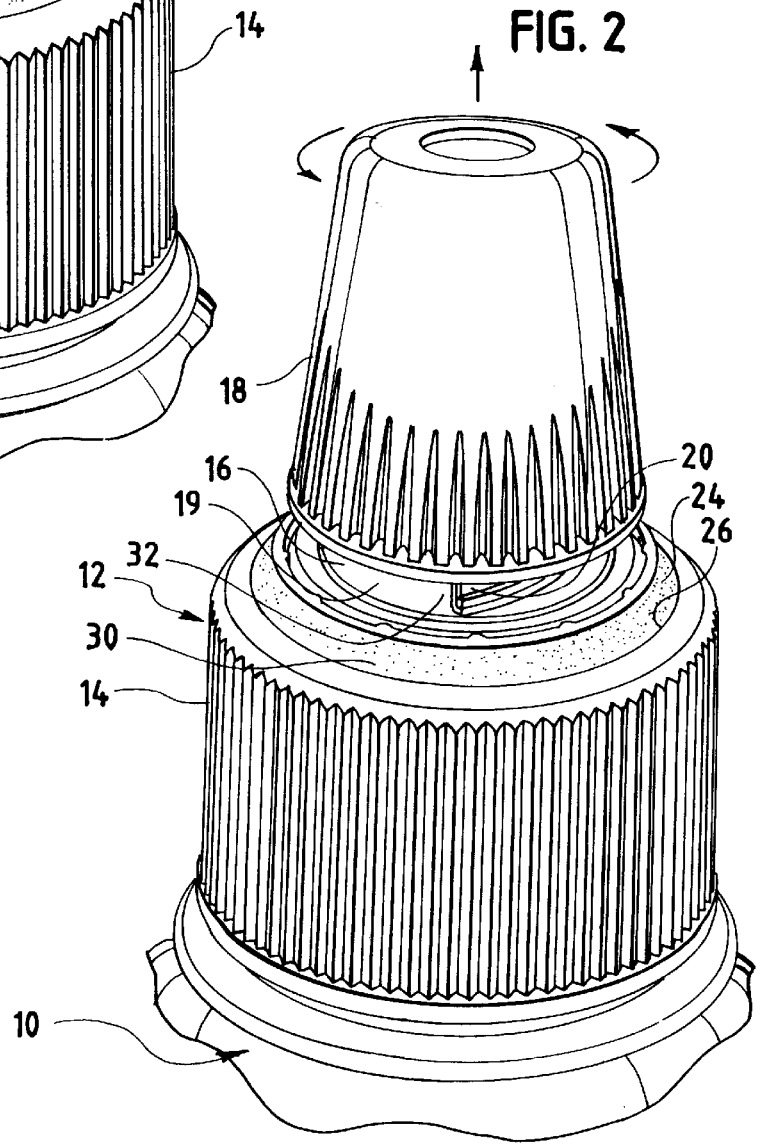
FIG. 2 is a perspective view of the closure of FIG. 1, with the spout being moved to its open position by twisting relative to the base, leaving behind the circumferential skirt retained in the circumferential channel formed in the base.
Figure 3:
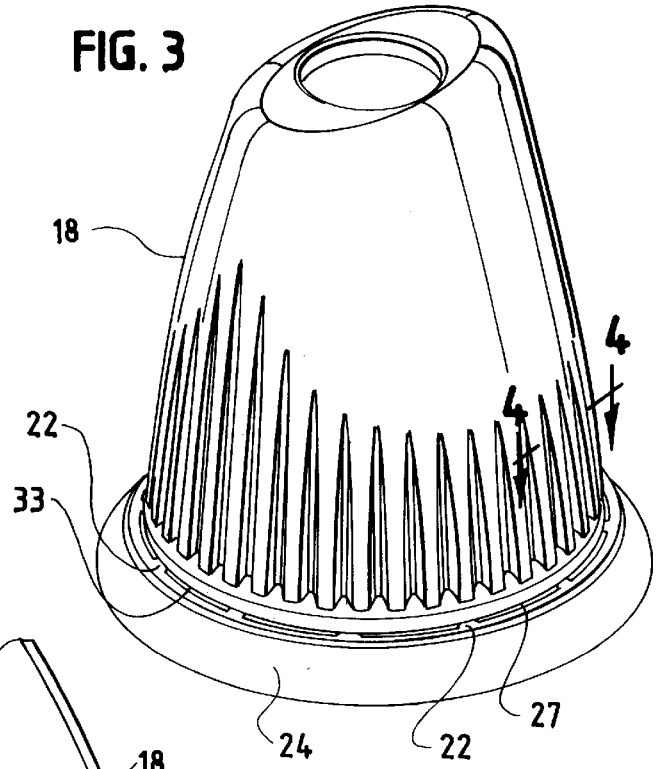
FIG. 3 is a perspective view of the spout with skirt shown prior to installation on its associated base.
Figure 13:
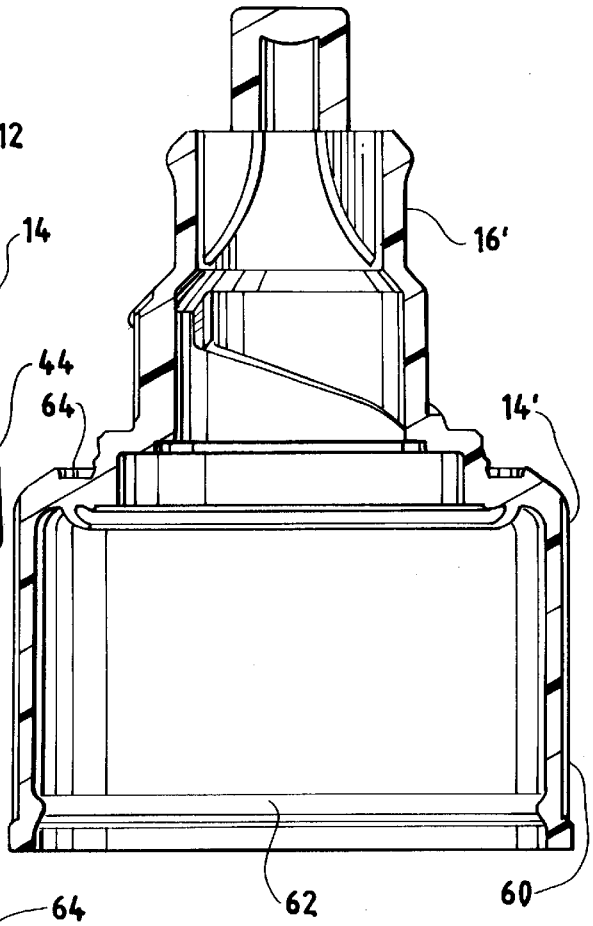
FIG. 13 is a sectional view taken along the line 13—13 of FIG. 12, in the direction indicted generally.

Referring to FIGS. 1 and 2, a container 10 (the upper portion of which only is illustrated) is shown having a cap 12 installed thereon in conventional manner, such as by threaded engagement (FIG. 11), or by snap-fit over a container opening (FIG. 13).

Cap 12 includes base 14 having upstanding post 16 (seen in FIG. 9), with spout 18 positioned thereon. The exterior surface 19 of the post 16 and the interior surface (not seen in the drawings) of the spout 18 are provided with cooperating engagement ramps 20. The specific configuration of the cooperating engagement ramps 20 does not form a part of the present invention and can take any of a wide variety of constructions, such as that disclosed in U.S. Pat. No. 4,967,941, which is owned by the same assignee as the assignee of the present application. For this purpose, the disclosure of said U.S. Pat. No. 4,967,941 is incorporated herein by specific reference. It is to be understood that a closure incorporating any form of engagement ramps, or other engagement means, between post 16 and spout 18 is within the scope of the present invention. The only requirement of such engagement means is that they function to permit the spout 18 to be moved between a first closed position on the base (FIG. 1 position) and a second open position on the base (FIG. 2 position). Pull-push type closures known in the art, as well as twist closures such as that shown in U.S. Pat. No. 4,967,941, can be used in conjunction with the present invention.

Referring to FIGS. 2–7, when it is desired to gain access to the contents of container 10, spout 18 is twisted and lifted on post 16 relative to base 14, breaking frangible spot seals or connections 22, which connect spout 18 with a circumferential skirt or projection 24 that is permanently retained by a force-fit into circumferential channel 26 which is defined in base 14 of cap 12. Thus, as shown in FIG. 2, spout 18 has now been separated from its circumferential skirt 24 which resides in circumferential channel 26, as particularly shown in FIG. 7.

Figure 4:
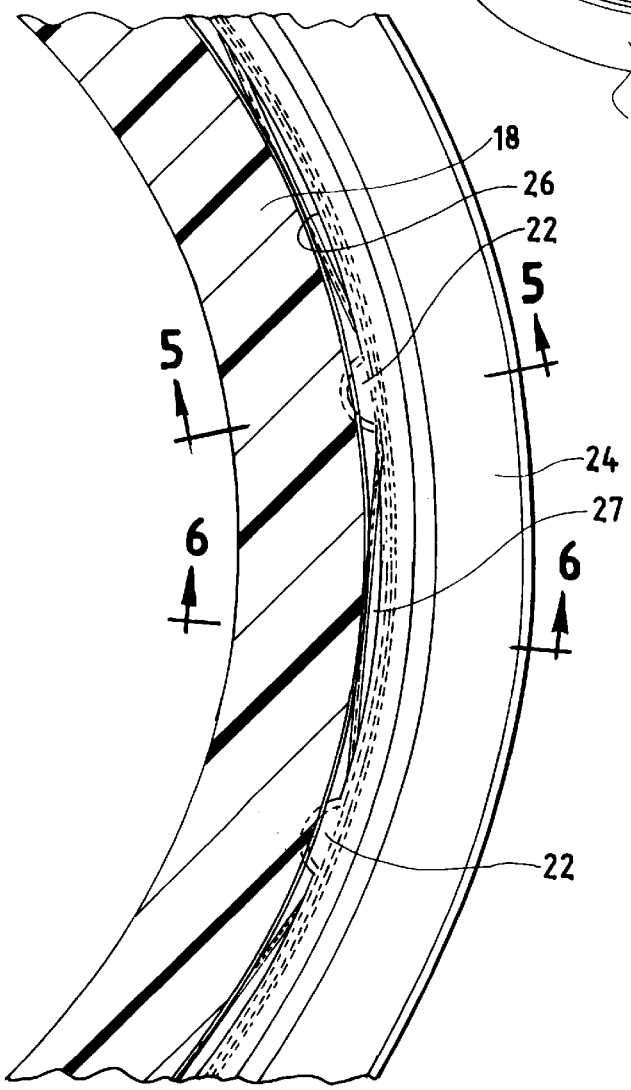
FIG. 4 is an enlarged, sectional view taken along the line 4—4 of FIG. 3, in the direction indicated generally.
Figure 5:
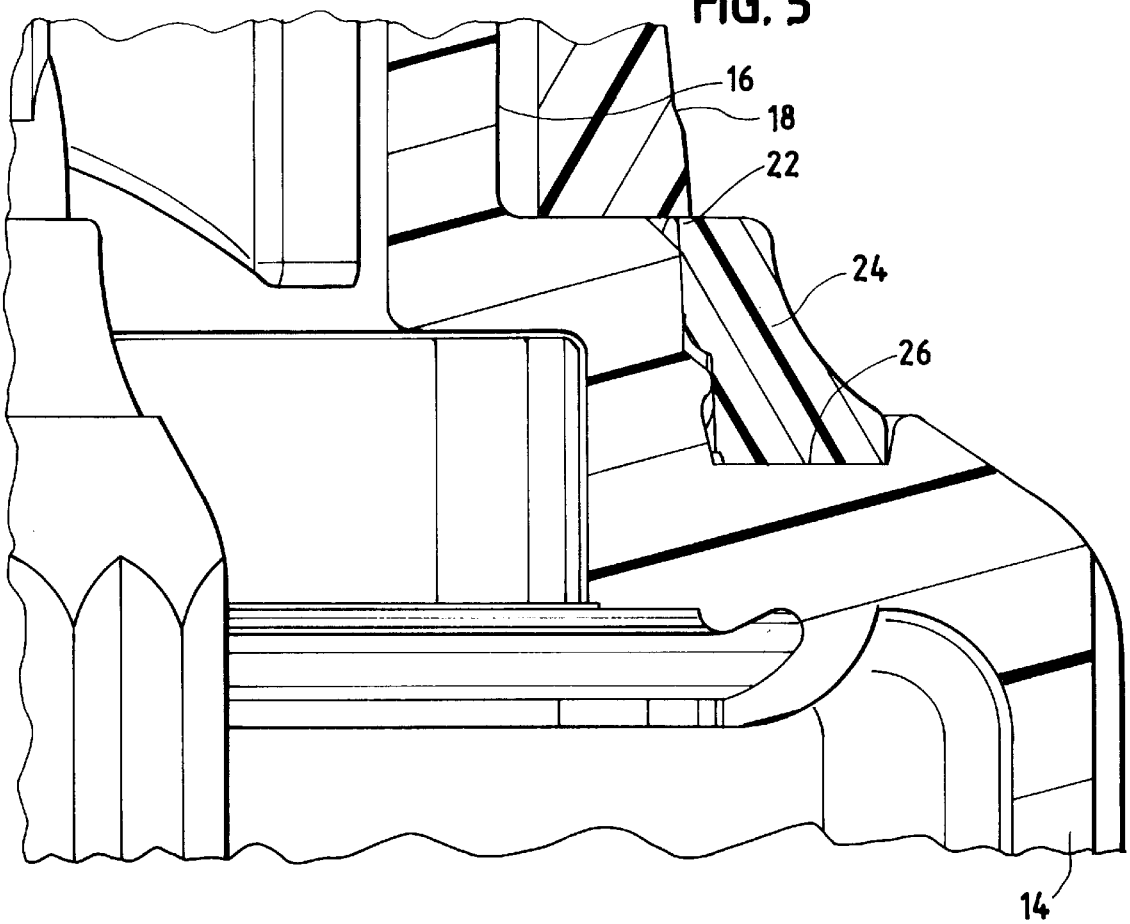
FIG. 5 is a further enlarged, sectional view taken along the line 5—5 of FIG. 4, in the direction indicated generally, but showing the spout positioned on the base.
Figure 6:
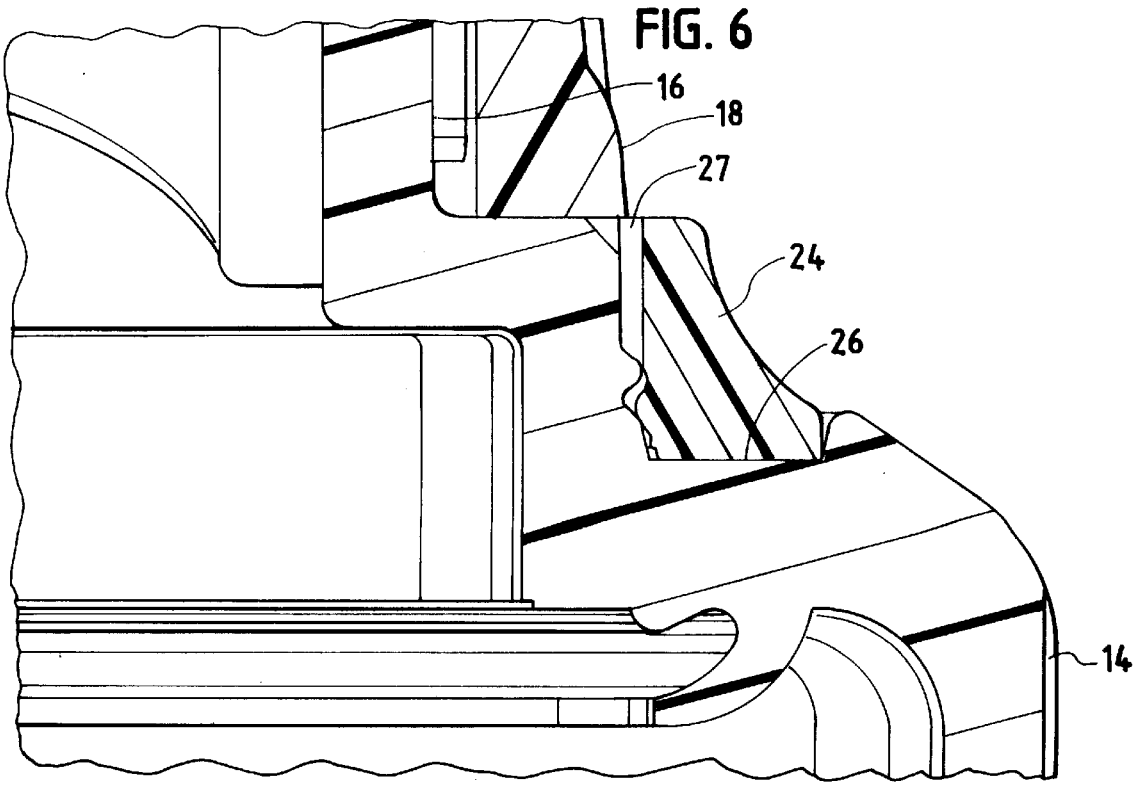
FIG. 6 is a further enlarged, sectional view taken along the line 6—6 of FIG. 4, in the direction indicated generally, but showing the spout positioned on the base.
Figure 7:
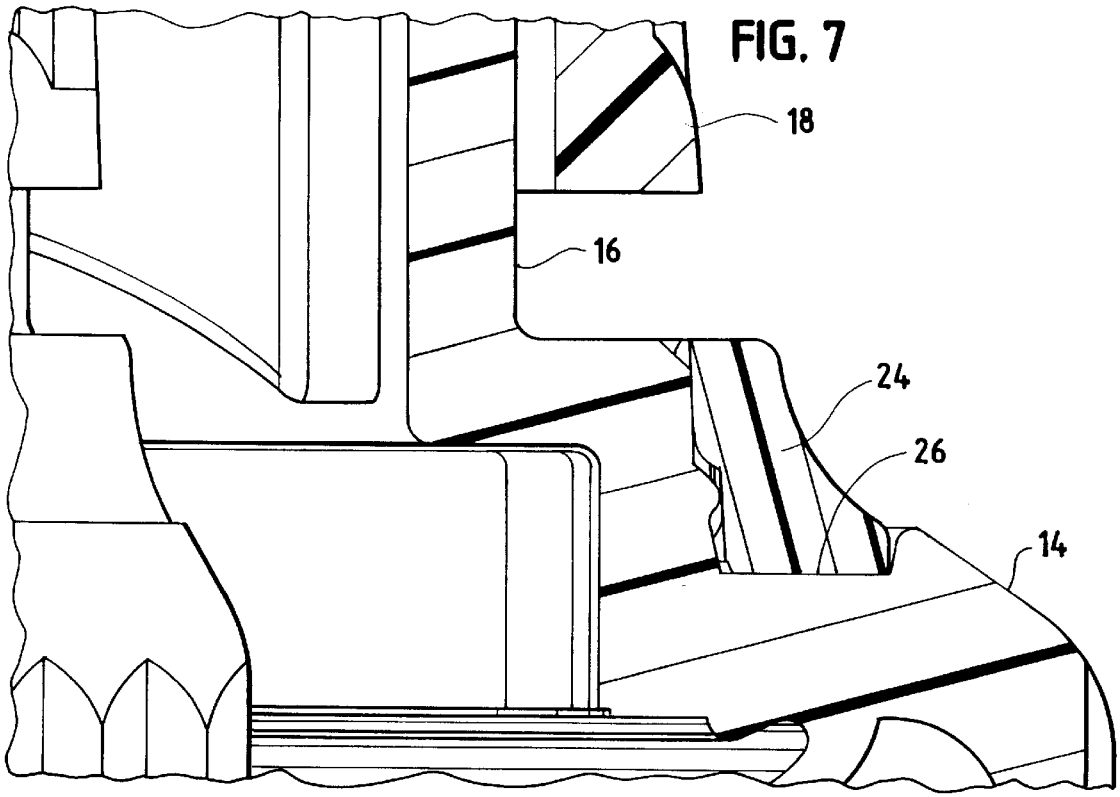
FIG. 7 is a transverse sectional view similar to that of FIG. 5, showing the spout separated from its associated skirt by breakage of spot seals.

FIGS. 4–6 show details of the spout 18 and its associated circumferential skirt 24, particularly spot seals or frangible connections 22, which intermittently connect spout 18 with circumferential skirt 24. Spout 18 and circumferential skirt 24 may be spaced from each other as illustrated by spaces 27 at other portions about their periphery.

In accordance with this invention, spout 18 and circumferential skirt 24, which may be formed initially as a single, integrally molded item, may for example be colored an arbitrary color white, while cap 12, and particularly base 14 thereof, may be colored a contrasting arbitrary color such as dark blue. Thus, one can visually see a white ring 30 (FIG. 2) after movement of spout 18 upwardly on post 16, which plainly signifies to the viewer the fact that the spout has been moved to its open position. In such open position, white colored spout 18 and while colored circumferential skirt 24 will be separated by exposed blue colored portion 32 of post 16 and white ring 30 will be clearly discernible to the user to indicate that the spout has been moved to its open position. The important feature is that the spout and its skirt is formed from material which is of a differing visual perception (such as color) than that of base 14 to enable an observer to differentiate one from the other.

Figure 8:
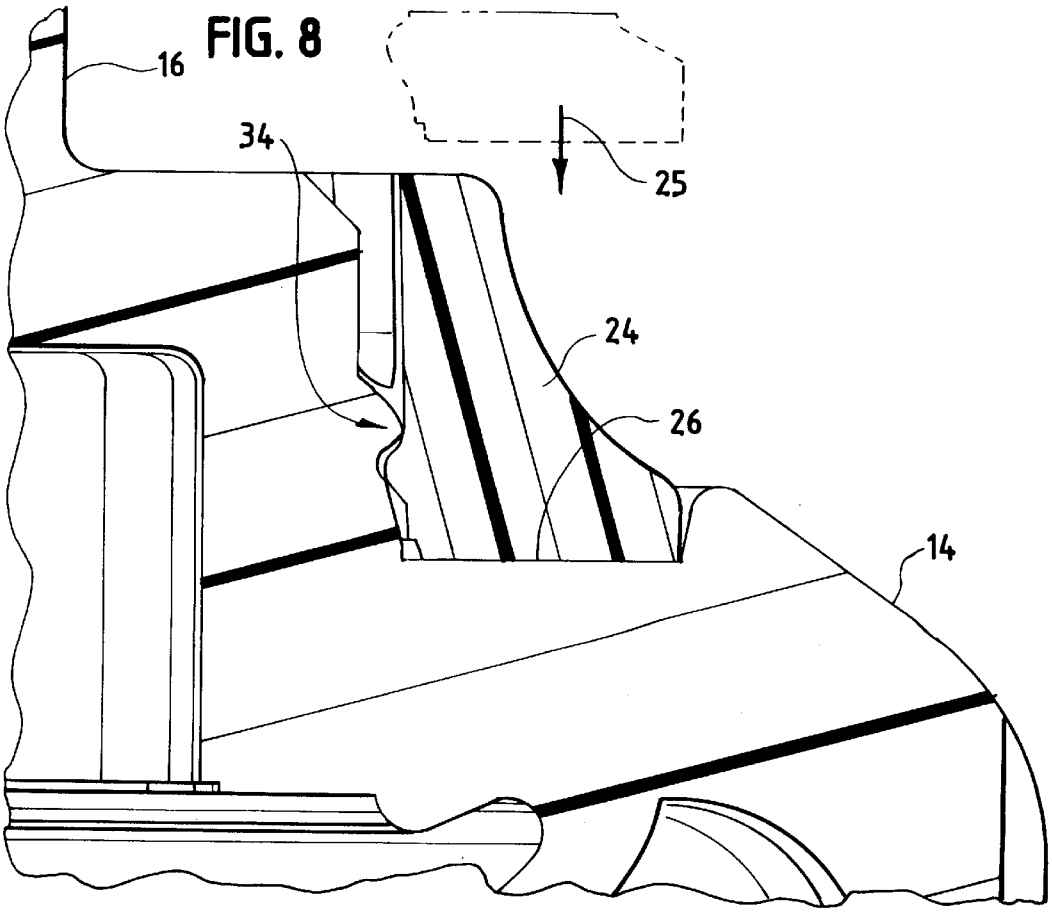
FIG. 8 is an enlarged, fragmentary, transverse sectional view showing how the circumferential skirt of the spout can be force-fit in an effectively permanent manner into the circumferential channel in the cap.

Referring to FIG. 8, base 14 of a cap for a container is shown, having a circumferential channel 26 which contains the circumferential skirt 24 of spout 18. Both channel 26 and skirt 24 may be shaped with a detent system 34 so that when skirt 24 is forcefully inserted into channel 26 (in the manner shown by arrow 25), it cannot be removed, but instead spout 18 is separated from skirt 24 by breakage of spot seals or the like along a line of weakness 33 (seen in FIG. 3) when spout 18 is moved on post 16 from closed position (FIG. 1 illustration) to open position (FIG. 2 illustration).

Figure 9:
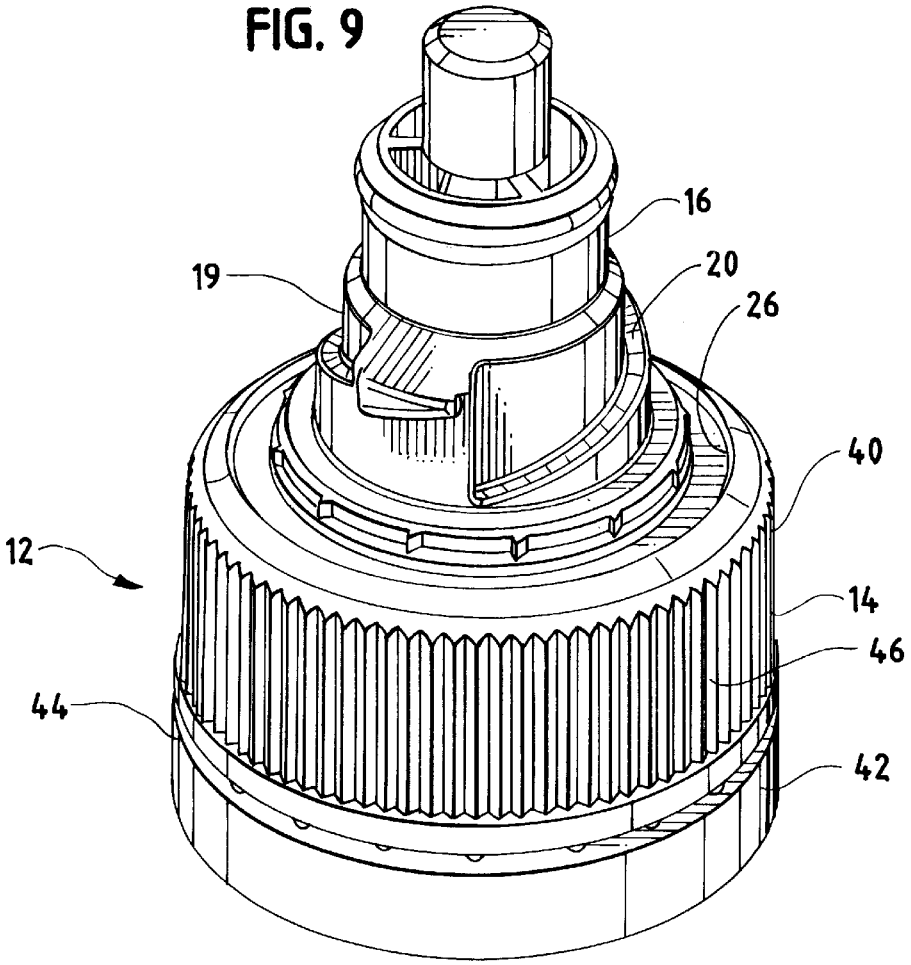
FIG. 9 is a perspective view of the base shown in FIG. 2.
Figure 10:
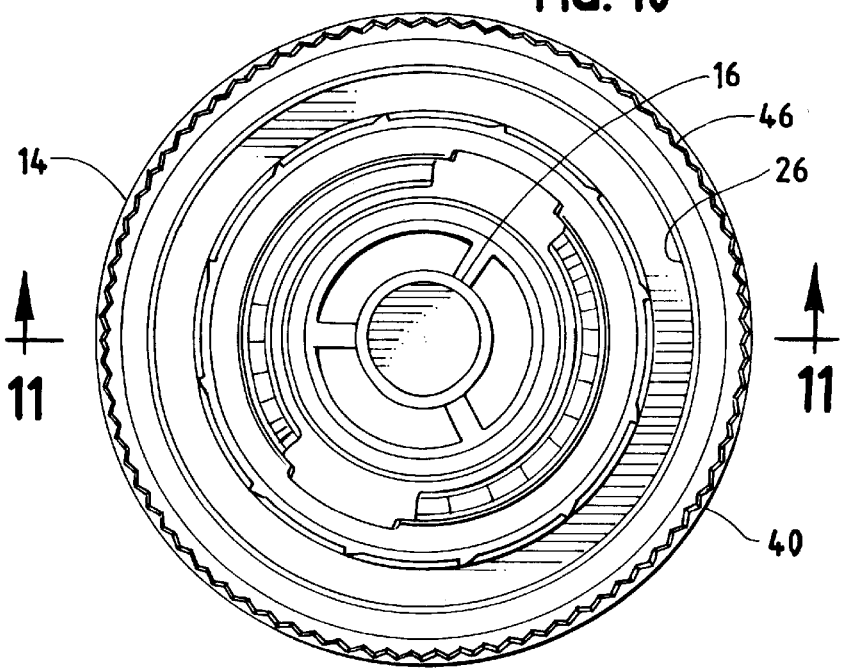
FIG. 10 is a plan view of the base of FIG. 9.
Figure 11:
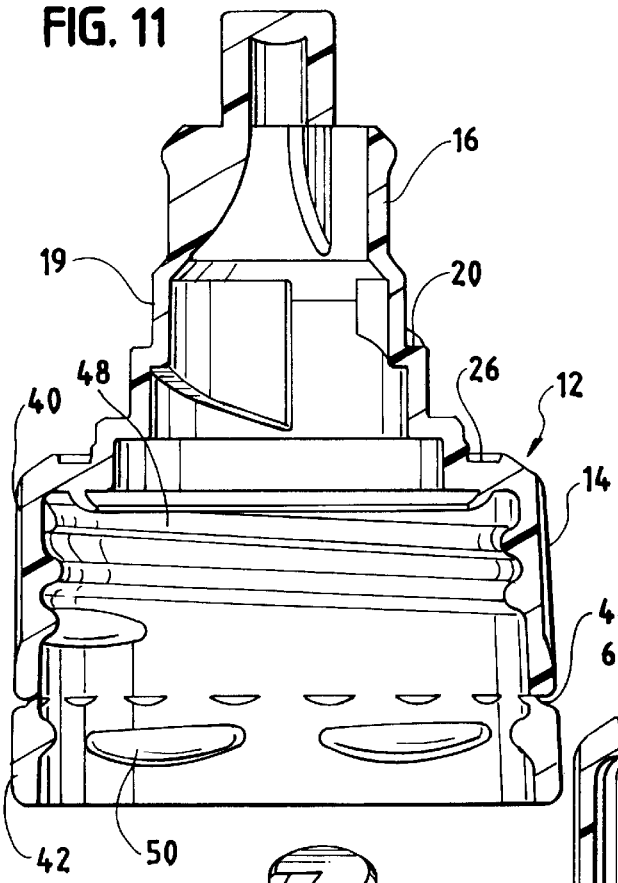
FIG. 11 is a longitudinal sectional view taken along the line 11—11 of FIG. 10, in the direction indicated generally.

Referring to FIGS. 9–11, a portion 40 of a cap is shown, in which the cap may be affixed to a container top with a tamper evident band 42 to be separated from the portion 40 along a separation line 44 when the cap is twisted by the user by asserting a force upon the knurled surface 46. The portion 40 is secured to the container top by screw threads 48. The tamper band is retained on the container top by inwardly projecting members 50 to engage a flange (not shown) on a container top in conventional manner. The cap portion 40 is formed with the circumferential channel 26 to receive the skirt 24 of overcap spout 18.

Figure 12:
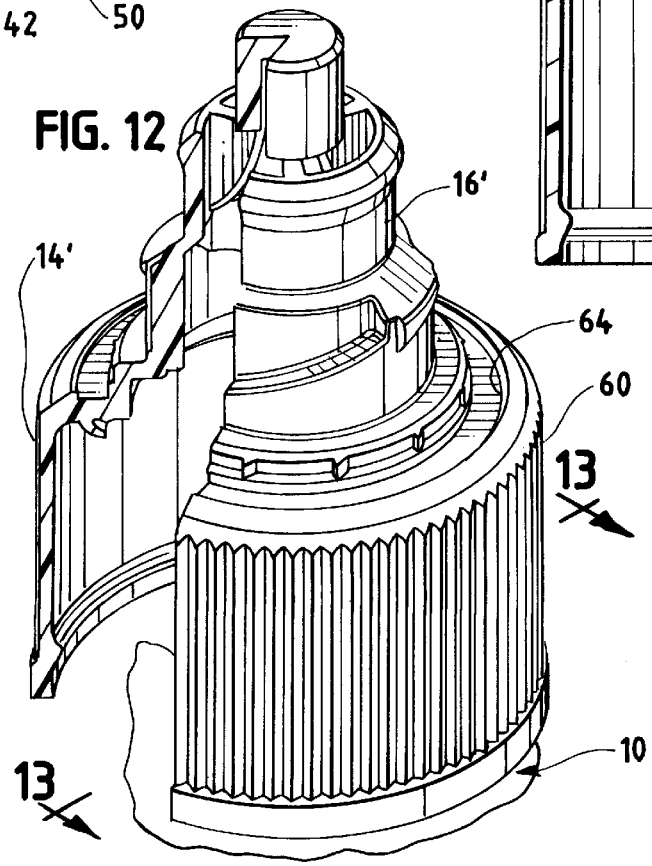
FIG. 12 is a perspective view of another embodiment of a base used in this invention.

Referring to FIGS. 12 and 13, another cap 60 is shown, which may be used in conjunction with spout 18. Cap 60 comprises an upstanding post 16' and a lower base portion 14' which is snap-fit over a container 10 by engagement of indentations 62 with the container top. Spout 18 may be engaged upon post 16' by positioning its skirt 24 within channel 64.

Figure 14:
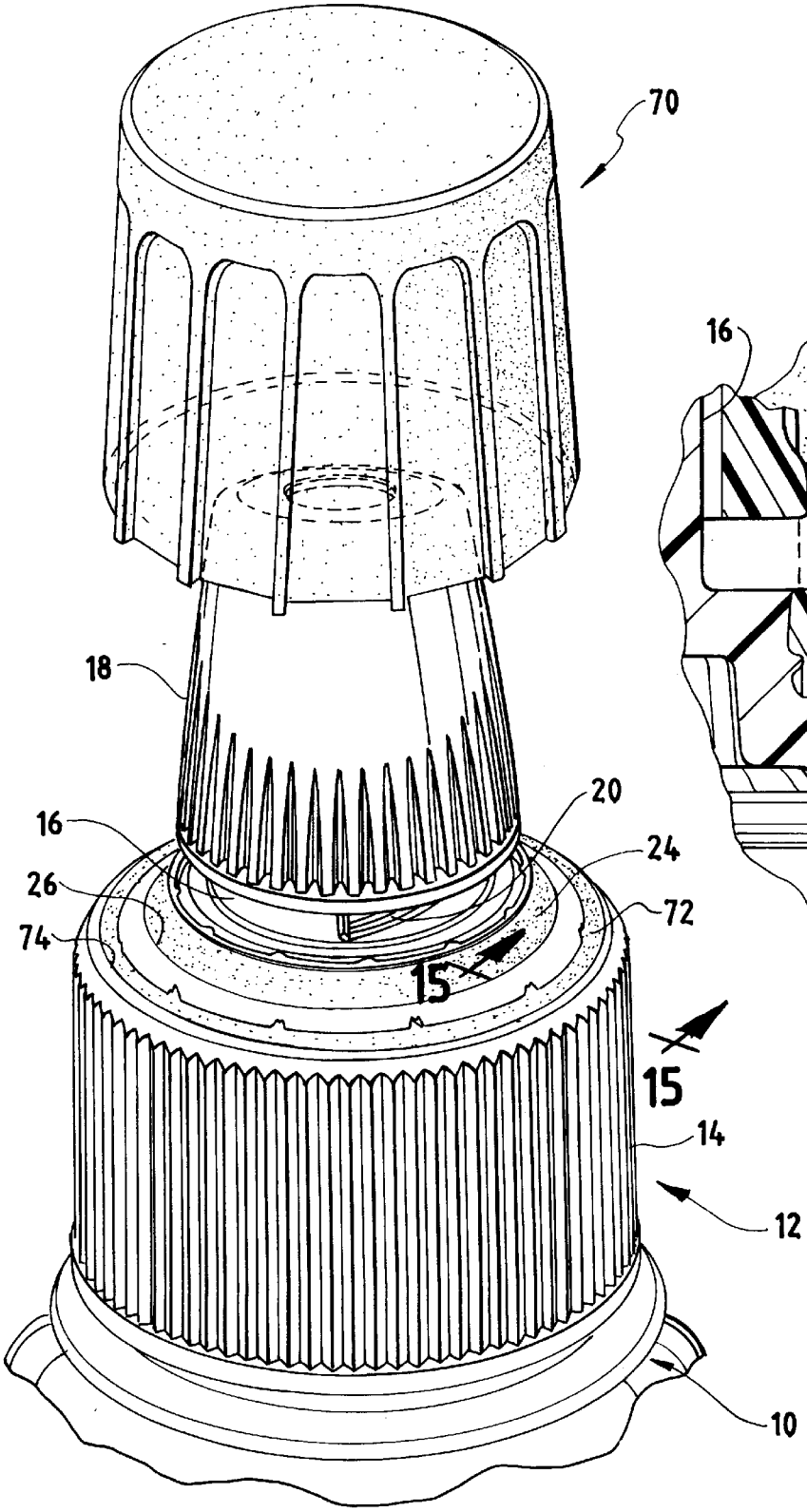
FIG. 14 is a partially exploded, perspective view of a modified embodiment of the closure shown in FIG. 2, with the taper-evident overcap of the Related Application illustrated in association therewith.
Figure 15:
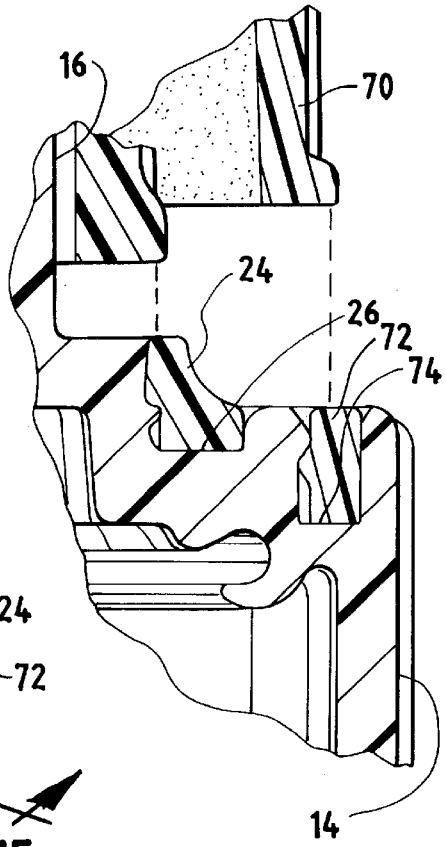
FIG. 15 is an enlarged sectional view taken along the line 15—15 of FIG. 14, in the direction indicated generally.

Referring to FIGS. 14 and 15, the tamper-evident overcap 70 of the Related Application is shown installed on cap 12 of the present invention, which includes spout 18 having circumferential skirt 24 retained in circumferential channel 26.

Overcap 70 includes circumferential skirt 72 which is positioned upon base 14 in a second circumferential channel 74 formed therein. Circumferential channels 26 and 74 are concentric with respect to each other. In all other respects, the construction and operation of the embodiment of FIGS. 14 and 15 is as described above and in the Related Application.

Minor variations in the structure and other variations in the arrangement and size of the various parts may occur to those skilled in the art without departing from the spirit or circumventing the scope of the invention as set forth in the appended claims.

We claim:

1. A tamper-evident closure comprising, a cap for a container, said cap including a base and an upstanding post, said base defining a generally U-shaped circular channel having side walls and a bottom, said bottom lying entirely within the base, and a spout positioned to enclose said upstanding post, said spout carrying a circumferential skirt press fitted into said channel to prevent any relative movement between said skirt and base, and a frangible line of weakness between said spout and said skirt permitting separation of said spout from said skirt, said skirt being of a color different from said base whereby upon separation of said spout, said skirt remains gripped in said channel serving as a colored ring indicator of such separation.

2. The closure as claimed in claim 1 in which said skirt and channel are provided with a detent system to aid in press fitting said skirt in said channel.

3. The closure as claimed in claim 1 in which said circular channel is spaced from said upstanding post through its extent.

4. The closure as claimed in claim 1, in which said skirt remains gripped in said channel after the spout is separated from the skirt.

5. The closure as claimed in claim 1 in which said spout and skirt are integrally molded.

6. The closure as in claim 1 in which said spout and skirt are of the same color.

7. In combination, a tamper-evident closure and a tamper-evident overcap for said closure, said closure comprising, a cap for a container, said cap including a base and an upstanding post, said base defining a generally U-shaped circular channel having side walls and a bottom, said bottom lying entirely within the base, and a spout positioned to enclose said upstanding post, said spout carrying a circumferential skirt press fitted into said channel to prevent any relative movement between said skirt and base, and a frangible line of weakness between said spout and said skirt permitting separation of said spout from said skirt, said skirt being of a color different from said base whereby upon separation of said spout, said skirt remains gripped in said channel serving as a colored ring indicator of such separation.

8. The combination as claimed in claim 7 in which said overcap includes a depending circumferential overcap skirt, said base defining a second circular channel, said overcap skirt being press fitted into said second circular channel.

9. The combination as claimed in claim 8 in which said channels are concentric.

10. The combination as claimed in claim 7 in which the spout and overcap are of the same color, but a color different than the color of the base.

* * * * *